United States Patent [19]

Russo

[11] 4,406,277

[45] Sep. 27, 1983

[54] FIREPLACE STOVE INSERT

[75] Inventor: Richard A. Russo, Abington, Mass.

[73] Assignee: Russo Manufacturing Corp., Randolph, Mass.

[21] Appl. No.: 302,501

[22] Filed: Sep. 16, 1981

[51] Int. Cl.[3] ..... F24B 7/00; F24C 15/30

[52] U.S. Cl. ..... 126/123; 126/126; 126/77; 126/292

[58] Field of Search ..... 126/77, 123, 126, 138, 126/121, 120, 112, 84, 245, 290, 292, 312; 237/51; 236/16, 45; 110/147, 163

[56] References Cited

U.S. PATENT DOCUMENTS

| | | | |
|---|---|---|---|
| 698,803 | 4/1902 | Cahoone | 126/77 |
| 891,900 | 6/1908 | Belvin | 126/77 |
| 2,545,680 | 3/1951 | Wyatt | 126/77 X |
| 4,300,526 | 11/1981 | McKay et al. | 126/77 |
| 4,320,741 | 3/1982 | Pierce | 126/123 |

*Primary Examiner*—Samuel Scott
*Assistant Examiner*—Randall L. Green
*Attorney, Agent, or Firm*—Thompson, Birch, Gauthier & Samuels

[57] ABSTRACT

The present invention is directed to the provision of an improved stove insert for a fireplace opening, having means associated therewith for precisely controlling draft, thereby enabling the stove insert to be used for coal as well as wood.

4 Claims, 5 Drawing Figures

FIREPLACE STOVE INSERT

BACKGROUND OF THE INVENTION

1. Field of the Invention

This invention relates to stove inserts for fireplace openings.

2. The Prior Art

Various stove designs have already been adapted for use as fireplace inserts. Most such designs are suitable for burning wood, where precise draft regulation is not particularly critical. However, although coal is a longer burning and more reliable fuel, the same stove designs cannot burn coal efficiently because they lack adequate draft control. Thus, on windy days when flue draft becomes excessive, coal fires burn too hot and too quickly, and valuable heat is lost up the flue.

SUMMARY OF THE INVENTION

The basic objective of the present invention is to provide an improved stove insert for a fireplace opening, having means associated therewith for precisely controlling draft, thereby enabling the stove insert to be used for coal as well as wood.

In a preferred embodiment of the invention to be described hereinafter in greater detail, a stove insert for a fireplace opening is interiorly subdivided by a grate assembly into an upper combustion chamber and a lower ash pit, with an exterior faceplate arranged to overlap the side and top edges of the fireplace opening, and with a flue connection leading from the combustion chamber to the fireplace flue. The faceplate seals off the fireplace opening and prevents room air from escaping up the flue. Front doors provide access to the combustion chamber and the ash pit, with the door leading to the ash pit having an adjustable louver through which air is admitted to support combustion of fuel supported on the overlying grate assembly. The stove insert has a double-walled construction defining an air heating passage which extends around the ash pit and combustion chamber and which communicates with inlet and outlet openings in the faceplate. Room air is circulated through and heated in the air heating passage.

An auxiliary air supply conduit leads from an inlet opening in the faceplate to an outlet opening in the flue connection. A barometric damper is positioned in the auxiliary air supply conduit at a location which is accessible from the front side of the faceplate. A flow of room air controlled by the damper is bled into the flue connection via the auxiliary air supply conduit, thereby automatically modifying the flue draft without pulling excessive air into the combustion chamber via the louver in the access door leading to the ash pit.

Preferably, a bypass tube leads from a second opening in the faceplate to the auxiliary air supply conduit at a location between the barometric damper and the outlet opening. The bypass tube provides a means of connecting a draft gauge which can be used to measure negative air pressure in the auxiliary air supply conduit when manually setting the barometric damper.

Preferably, a slide valve is provided in the flue connection downstream from the outlet opening of the auxiliary air supply conduit. The slide valve is adjustable by means of a control handle accessible from the front side of the faceplate.

DETAILED DESCRIPTION OF PREFERRED EMBODIMENT

Figure 1:
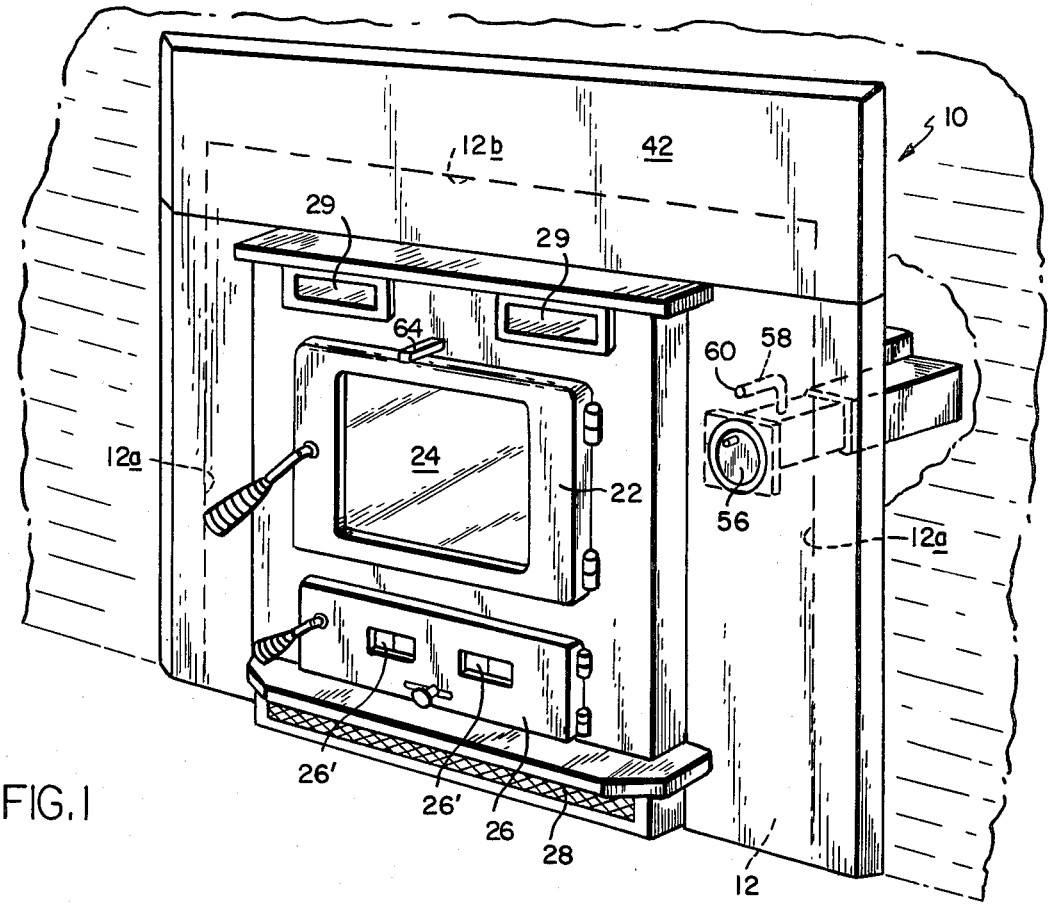
FIG. 1 is a front perspective view of a stove insert in accordance with the present invention shown positioned in a fireplace opening.

Referring now to the drawings, a stove insert in accordance with the present invention is shown at 10 inserted in a fireplace opening 12. The stove insert has a housing 14 interiorly subdivided by a grate assembly 16 into an upper combustion chamber 18 and a lower ash pit 20. An upper door 22 with a viewing window 24 is provided at the front of the housing to provide access to the combustion chamber 18. A lower door 26 in the housing front provides access to the ash pit 20. The lower door has manually adjustable louvers 26' through which room air may be admitted into the housing interior.

The stove insert has a double-walled construction defining an air heating passage having a lower section 27*a* leading rearwardly beneath the ash pit from an inlet opening 28, vertical sections 27*b* leading upwardly along the back of the ash pit and combustion chamber, and upper sections 27*c* leading to outlet openings 29. Room air is circulated through the air heating passage, either by natural convection, or by a motor-driven fan (not shown).

A flue connection 30 leads from a flue outlet 32 in the combustion chamber 18. The flue connection has a rectangular upper end 34 adapted for connection as at 36 to the fireplace flue 38. An inclined removable baffle 40 is arranged beneath the flue outlet 32.

Figure 2:
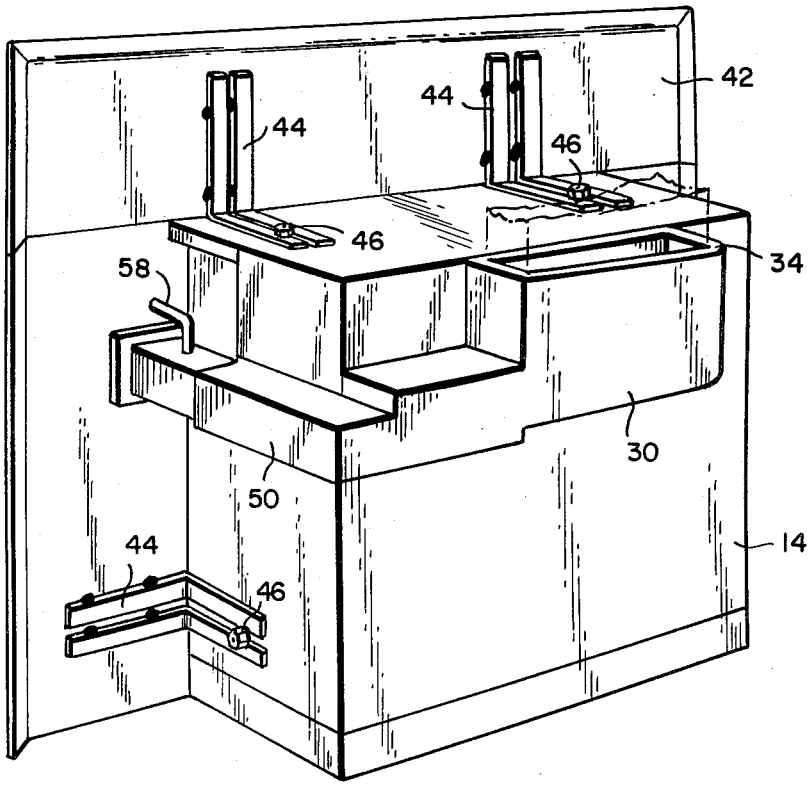
FIG. 2 is a rear perspective view of the stove insert.
Figure 3:
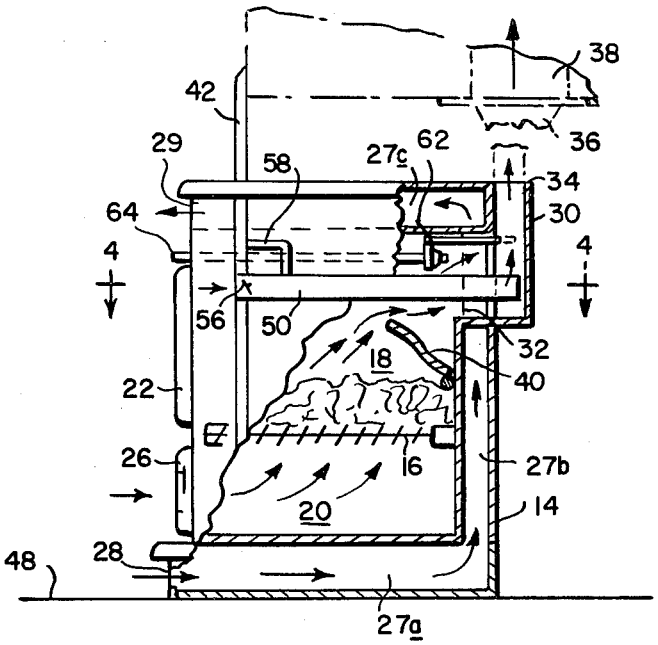
FIG. 3 is a schematic side elevation with portions broken away.
Figure 4:
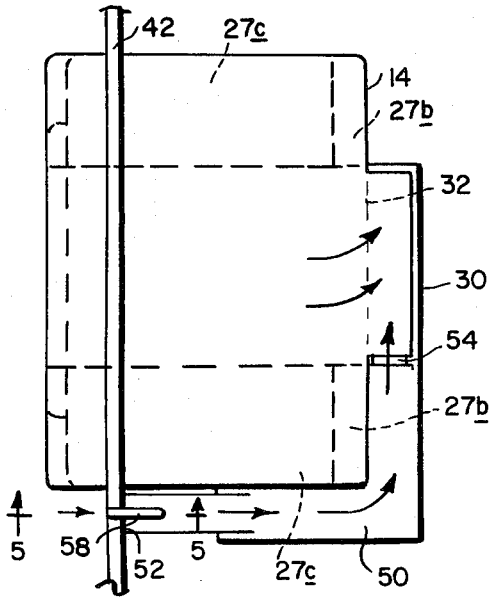
FIG. 4 is a horizontal sectional view taken along line 4—4 of FIG. 3; and, FIG. 5 is an enlarged sectional view taken along line 5—5 of FIG. 4.
Figure 5:
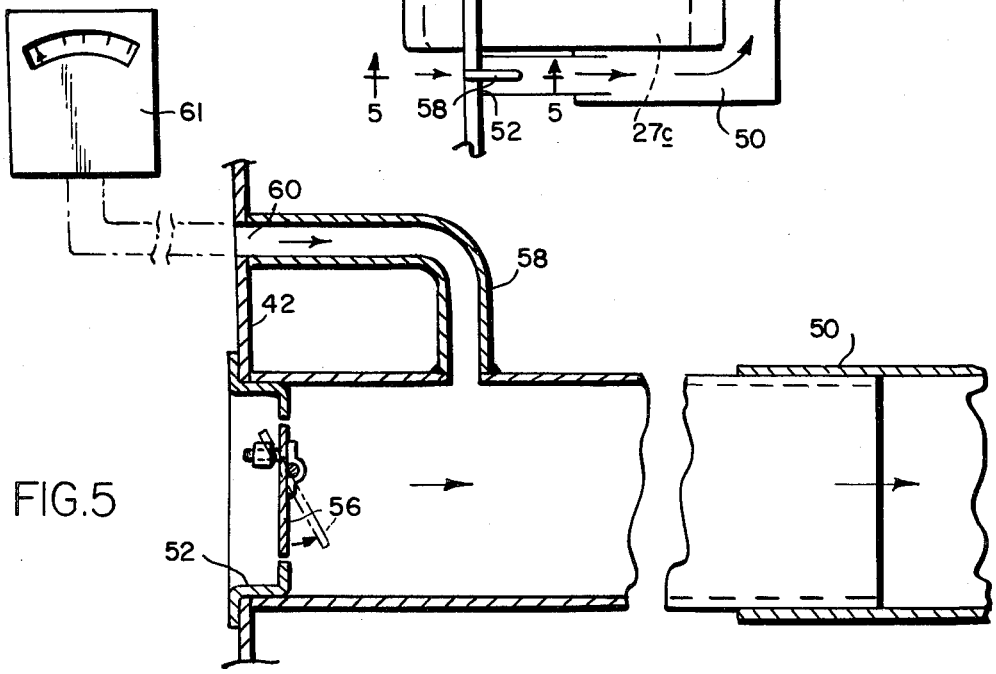

The housing 14 protrudes forwardly through a faceplate 42. As shown in FIG. 2, the rear of the faceplate 42 is provided with brackets 44 which are connected by bolts 46 to the housing 14. By loosening the bolts 46, the extent of which the housing protrudes through the faceplate can be adjusted to align the flue connection 30 with the fireplace flue 38. The faceplate 42 extends upwardly from the fireplace hearth 48 and is appropriately dimensioned to overlap and seal off the side and top edges 12*a*, 12*b* of the fireplace opening 12.

During use, fuel is loaded into the combustion chamber through the upper door 22. As the fuel burns, combustion gases are exhausted through the flue connection 30 and fireplace flue, and fresh combustion air is admitted through the louvers 26' in the lower door 26. Conventionally, the rate at which air is admitted into the housing interior is governed by the draft in the fireplace flue 38. On very cold or windy days, if the draft becomes excessive, an excessive amount of air will be drawn into the housing interior, thus causing fuel in the combustion chamber 18 to burn too rapidly. When this occurs, heating efficiency drops dramatically due to a large heat loss up the fireplace flue. To some extent, this loss can be controlled by adjusting the louvers 26'. but such adjustments do not respond automatically to draft fluctuations. Thus, unless the stove can be attended continuously, combustion is still likely to be inefficient.

The present invention deals with this problem by providing an auxiliary air supply conduit 50 which bypasses the combustion chamber 18 and which leads from an inlet opening 52 in the faceplate 42 to an outlet opening 54 in the flue connection. A barometric damper 56 is arranged in the conduit 50 at the inlet opening 52. The damper is accessible from the front of the faceplate and can thus be manually set to thereafter automatically feed a controlled amount of additional fresh air into the flue connection 30 when the draft in the fireplace flue 38 exceeds a selected maximum fuel. This additional air replaces air that would otherwise have to be drawn through the combustion chamber 18 via the louvers 26'. Thus the rate of burn in the combustion chamber remains largely unaffected by draft surges in the fireplace flue.

In order to make it possible to achieve an accurate setting for the damper 56, a bypass tube 58 is provided which leads from a second opening 60 in the faceplate 42 into communication with the auxiliary air supply conduuit 50 at a location between the damper 56 and the outlet opening 54. A draft gauge 61 can be connected to the opening 60 to measure the negative air pressure in conduit 50 while manually setting the damper 56 for subsequent automatic operation.

In order to provide additional draft control, a slide valve 62 is located in the flue connection 30 downstream from the outlet opening 54 of the auxiliary air supply conduit 50. The slide valve 62 is manually adjustable by means of a control handle 64 protruding through the faceplate 42.

I claim:

1. A stove insert for a fireplace opening, comprising in combination: a stove housing interiorly subdivided by a grate assembly into an upper combustion chamber and a lower ash pit, with access doors in the front of said housing leading to said combustion chamber and ash pit, the access door leading to said ash pit having adjustable means for admitting air into said housing; a flue connection for conveying combustion gases from said combustion chamber to the fireplace flue; a faceplate through which the front portion of said stove housing protrudes, said faceplate being adapted to extend upwardly from the fireplace hearth and to overlap the side and top edges of the fireplace opening; an auxiliary air supply conduit leading from an inlet opening in said faceplate to an outlet opening in said flue connection; and a barometric damper positioned in said auxiliary air supply conduit, said damper being accessible from the front side of said faceplate.

2. The stove insert of claim 1 further comprising a bypass tube leading from a second opening in said faceplate and being in communication with said auxiliary air supply conduit at a location between said barometric damper and said outlet opening, said second opening being adapted for connection to a draft gauge for use when manually adjusting the setting of said barometric damper.

3. The stove insert of claims 1 or 2 further comprising valve means in said flue connection for controlling the flow of gases therethrough, said valve means being adjustable by a control handle accessible from the front side of said face plate.

4. The stove of claim 3 wherein said valve means is arranged downstream from the outlet opening of said auxiliary air supply conduit.

* * * * *